United States Patent [19]

Rudd, Sr.

[11] Patent Number: 4,947,710

[45] Date of Patent: Aug. 14, 1990

[54] HAIR SCULPTURING RAZOR

[75] Inventor: M. David Rudd, Sr., Paducah, Ky.

[73] Assignee: W. Ralph Bean, Eldorado, Ill. ; a part interest

[21] Appl. No.: 411,839

[22] Filed: Sep. 25, 1989

Related U.S. Application Data

[62] Division of Ser. No. 163,089, Mar. 2, 1988, Pat. No. 4,887,356.

[51] Int. Cl.[5] ..... B21K 21/00

[52] U.S. Cl. ..... 76/119; 76/DIG. 8

[58] Field of Search ..... 30/30, 31, 346.55, 346.56, 30/346.61, 355, 53; 76/101 R, 101 D, 104 R, DIG. 8, DIG. 9

[56] References Cited

U.S. PATENT DOCUMENTS 1,435,514 11/1922 Burns ..... 76/104 A 1,540,078 6/1925 Long ..... 76/DIG. 6

OTHER PUBLICATIONS

The Razor Edge Book of Sharpening, John Juranitch et al., Warner Books, New York, NY, 1985, at p. 28.

*Primary Examiner*—Douglas D. Watts

*Attorney, Agent, or Firm*—Robert M. Phipps

[57] ABSTRACT

Razors for care of hair are improved by providing the razor with a cutting edge having a series of uniformly spaced imperfections or dents extending across said cutting edge, the dents dulling from 20 to 75 percent of the normal cutting edge of the razor. The normal razor cutting edge is transformed into the edge of this invention by use of a dulling tool. The dented edge razor permits the user, e.g., barber or beautician, to more effectively sculpture a head of hair with greater safety to the user and patron.

5 Claims, 2 Drawing Sheets

HAIR SCULPTURING RAZOR

This is a division of application Ser. No. 163,089, filed Mar. 2, 1988, now U.S. Pat. No. 4,887,356.

BACKGROUND

1. Field of the Invention

This invention relates to a razor for sculpturing, thinning and similar activities during the grooming of an individual's hair.

2. Description of the Prior Art

The book *The Razor Edge Book of Sharpening,* John Juranitch et al, Warner Books, New York, NY 1985, at page 28, discusses serrated edges of knives and the like. It states a serrated edge is for tearing its way through an object, not cutting through the object.

Scissors, razors, and other instruments have been employed in the sculpturing, thinning and similar effects of hair care provided by barbers and beauticians. However, these devices have not enabled the average barber or beautician to obtain consistent results. It has often been said of the standard barber's thinning scissors that no one knows how to properly use them, because their use typically did not result in a well shaped head of hair. The often used straight razor presents additional concerns for safety, both to the operator and the patron, during hair sculpturing or styling.

It is therefore an object of this invention to provide razors with improved cutting edges for hair sculpturing and related barbering services. Another object is to provide a method of making improved cutting edges on razors for hair sculpturing and thinning. Still other objects will be apparent to those skilled in the art upon reference to the following detailed description.

SUMMARY OF THE INVENTION

In accordance with this invention there is provided razors for care of hair wherein the improvement comprises providing said razor with a cutting edge having a series of uniformly spaced imperfections or dents extending substantially perpendicularly across said cutting edge, said dents dulling from 20 to 75 percent of the normal cutting edge of said razor. The normal cutting edge is transformed into the edge of this invention by use of a dulling tool.

DESCRIPTION OF THE PREFERRED EMBODIMENTS

Figure 1:
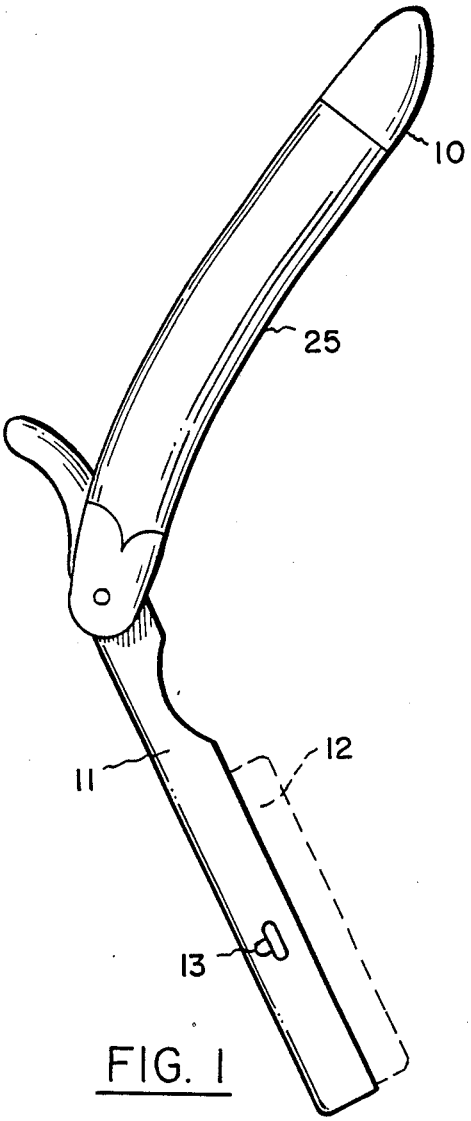
FIG. 1 is a side view of a conventional hair sculpturing razor.
Figure 2:
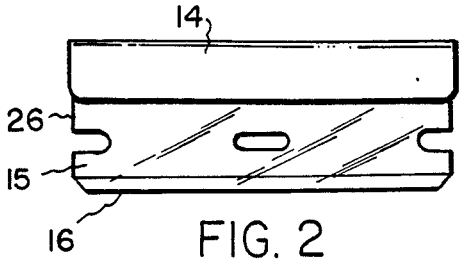
FIG. 2 is a side view of a conventional hair sculpturing razor blade.

FIG. 1 is the side view of a conventional hair sculpturing razor 25 composed of a handle 10, a razor blade holder 11 and a razor blade release 13. The location of an inserted razor blade 12 is indicated by the dotted line outlining a blade. In FIG. 2, a side view, a conventional blade 26 is shown to be comprised of a back stiffener 14 and a blade web 15 with a cutting edge 16.

People generally, as well as barbers and beauticians in particular, heretofore have maintained that to obtain the greatest success with a razor 25 it was necessary that the cutting edge 16 of the razor blade 26 be fully sharpened at all times. A dull cutting edge 16 of the razor blade 26, or the older straight razor with permanently affixed cutting edge (not illustrated), is unacceptable to the general public and professionals alike. Yet, this insistence on sharpness presents real concerns of safety to both the professional and patron during the hair sculpturing or cutting process.

It has now been discovered that the controlled denting of a razor's cutting edge makes it possible to improve the quality of hair grooming while at the same time reducing the risk of cutting either the professional or patron. While not wishing to be bound by any theory, applicant presently believes the dented or dulled part of the blade acts as runners so that the razor cutting edge slides across the hair, keeping the sharp portion of the blade from cutting deep into the hair. This invention is applicable to razors of the interchangeable blade types (including safety razors) as well as the older straight razors with permanently attached cutting edges. Additionally, the invention is applicable to the so called limited use disposable or throw away razors now gaining commercial acceptance.

Figure 3:
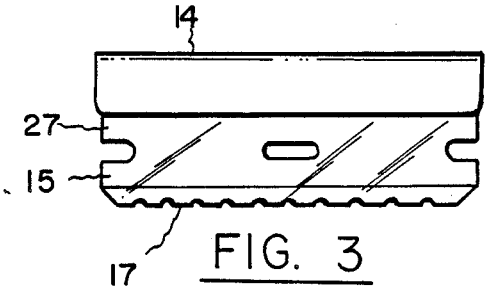
FIG. 3 is a side view of a 25 percent dulled hair sculpturing razor blade of this invention.
Figure 4:
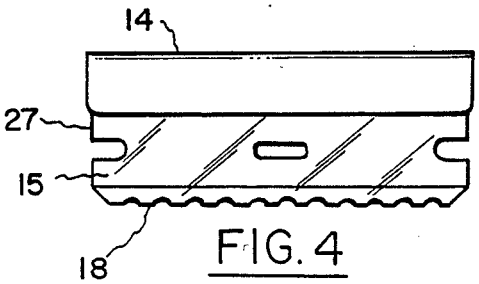
FIG. 4 is a side view of a 50 percent dulled hair sculpturing razor blade.
Figure 5:
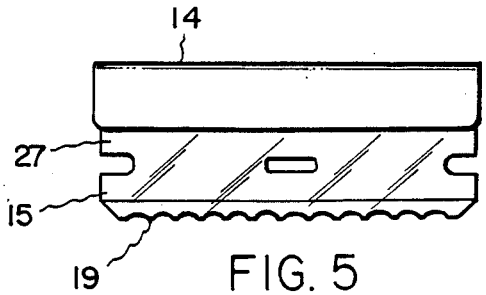
FIG. 5 is a side view of a 65 percent dulled hair sculpturing razor blade.

A conventional razor blade 26 for a razor 25 is shown in FIG. 2. Razor blades of this invention 27 are illustrated in FIGS. 3 through 5. In each case the razor blade 27 has a back stiffener 14 and a blade web 15, the same as a conventional razor blade 26. However, the cutting edge differs. In contrast to the conventional cutting edge 16 shown in FIG. 2, the razor blade 27 cutting edges are dented or dulled. Cutting edge 17 in FIG. 3 has an edge which is about 25 percent dented and 75 percent sharp. Cutting edge 18 in FIG. 4 has an edge which is about 50 percent dented and 50 percent sharp. Cutting edge 19 in FIG. 5 has an edge which is about 65 percent dented and 35 percent sharp.

The dented blade 27 is used by the barber or beautician in the same manner for hair sculpturing or thinning as a conventional razor blade 26. Dented blade 27 is slipped into the razor blade holder 11 and held in position by moving the razor blade release 13 to the closed position. The hair is then styled using the usual razor cutting stroke method. The desired shaping of the head of hair is obtained more easily and with less concern for safety with this invention as compared to the conventional sharpened straight razor. Razor 25 with dented blade 27 controls the amount of hair cut more than the user does while at that same time giving the user more control of the grooming with out slips in the cutting stroke, gouging and the like. In contrast razor 25 with conventional blade 26 does not offer this control.

As the amount of dulling or denting is increased the user obtains better control over the cutting of the hair while the amount of hair cut per stroke is decreased. The amount of denting can be varied from 20 to 75 percent of the cutting edge, while a dulling range of 50 to 65 percent is preferred. The actual amount of dulling can be varied to suit the desire of the individual user.

Figure 6:
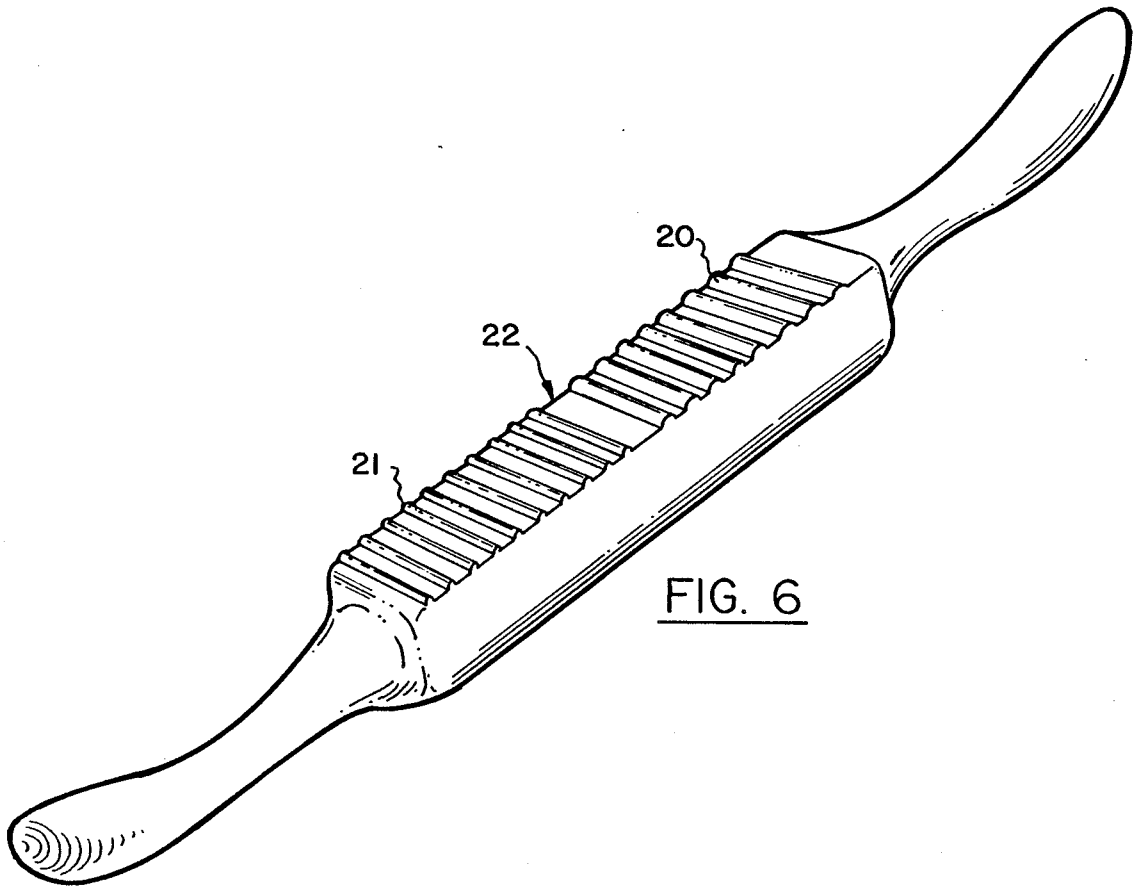
FIG. 6 is the top view of the dulling tool of this invention.

The desired amount of denting or dulling is conveniently achieved by the use of a denting tool. A typical denting tool 22 is shown in FIG. 6. The tool 22 has two different denting sections, a low ratio of coarse denting section 20 and a high ratio or fine denting section 21.

Denting tools with only one section can be used, however more convenient results are achieved when tool 22 has two or more denting sections. The longer tool 22 is easier to work with and offers convenience in selecting dulling ratios. The ratio of denting for each razor blade 27 can be varied to suit the individual user.

The tool 22 is made of a strip of metal, e.g., steel, and can vary in length depending on the desire of the individual and the number of denting sections present. Each denting section should be longer than the length of the cutting edge to be dulled. There is a separate section for each ratio of dulling to be achieved.

The denting surfaces are prepared by cutting a series of uniform lands and groves on the bar. The depth of the groves can be vary as desired, an ⅛ inch (3 mm) being satisfactory. The lands are preferably flat or having a slight downward rounding toward the groves. The aggregate length of the width of the individual lands in one section divided by the length of the section yields the dulling ratio of that section.

The cutting edge of blade 27 is prepared by placing the edge 16 of a conventional razor blade 26 on the desired section of dulling tool 22 and lightly tapping the blade 26. To hold the razor blade 26 in place during tapping a holding jig (not illustrated) may be employed. The dulling process is equally applicable to razor blades 26 with hollow ground edges and to blades with a conventional straight ground edge.

The foregoing examples and methods have been described in the foregoing specification for the purpose of illustration and not limitation. Many modifications and ramifications will naturally suggest themselves to those skilled in the art based on this disclosure. These are intended to be comprehended as within the scope of this invention.

The embodiments of the invention in which as exclusive property or privilege is claimed are defined as follows:

1. A method of preparing dulled razors comprising placing the cutting edge of a regularly sharpened razor on a dulling tool and lightly tapping the razor to dull the cutting edge, said dulling tool comprising a metal bar having an uniformly spaced series of lands and groves cut into said bar, the ratio of the aggregate widths of the lands to the length of the groved section being from 20 to 75 percent.

2. The method of claim 1 wherein the ratio of lands to total length is from 50 to 65 percent.

3. The method of claim 1 wherein the razor cutting edge is the edge of a detachable razor blade.

4. The method of claim 1 wherein the razor cutting edge is permanently attached to the razor.

5. The method of claim 1 wherein the blade to be dulled is held in a jig.

* * * * *